US011652312B1

(12) United States Patent
Insalaco

(10) Patent No.: US 11,652,312 B1
(45) Date of Patent: May 16, 2023

(54) FUNCTIONAL INDOOR ELECTRICAL WALL OUTLET COVER

(71) Applicant: Socket Solutions, LLC, Houston, TX (US)

(72) Inventor: Michael George Insalaco, Houston, TX (US)

(73) Assignee: Socket Soluons, LLC, Houston, TX (US)

( * ) Notice: Subject to any disclaimer, the term of this patent is extended or adjusted under 35 U.S.C. 154(b) by 0 days.

(21) Appl. No.: 17/185,894

(22) Filed: Feb. 25, 2021

Related U.S. Application Data

(63) Continuation-in-part of application No. 17/175,604, filed on Feb. 12, 2021.

(51) Int. Cl.

| | |
|---|---|
| ***H01R 13/447*** | (2006.01) |
| ***H01R 13/652*** | (2006.01) |
| ***H01R 13/639*** | (2006.01) |
| *H01R 25/00* | (2006.01) |

(52) U.S. Cl.
CPC ..... *H01R 13/447* (2013.01); *H01R 13/6392* (2013.01); *H01R 13/652* (2013.01); *H01R 25/003* (2013.01)

(58) Field of Classification Search
CPC ..... H01R 13/447; H01R 13/6392; H01R 13/652; H01R 25/003
USPC ..... 174/67
See application file for complete search history.

(56) References Cited

U.S. PATENT DOCUMENTS

| | | | |
|---|---|---|---|
| 3,714,616 | A | 1/1973 | Sample |
| 4,043,629 | A | 8/1977 | Brannen |
| 4,451,108 | A | 5/1984 | Skidmore |
| 4,797,507 | A | 1/1989 | Lefving |
| 5,002,502 | A | 3/1991 | Hill |
| 5,004,435 | A | 4/1991 | Jammet |
| 5,094,630 | A | 3/1992 | Jammet |
| 5,375,728 | A | 12/1994 | West |
| 5,401,184 | A | 3/1995 | Sandstrom |
| 5,542,852 | A | 8/1996 | Hush |
| 5,723,816 | A | 3/1998 | Neece |
| 6,703,562 | B1 | 3/2004 | Pacheco |
| 6,897,381 | B2 | 5/2005 | He |
| 6,977,342 | B1 | 12/2005 | Maltby |
| 7,229,322 | B2 | 6/2007 | Bangert |
| 8,317,527 | B2 | 11/2012 | Vitale |

(Continued)

*Primary Examiner* — Abdullah A Riyami
*Assistant Examiner* — Vladimir Imas
(74) *Attorney, Agent, or Firm* — Karen B. Tripp

(57) ABSTRACT

An indoor electrical wall outlet cover permitting functional use of an electrical wall outlet while concealing the plug contact openings of the outlet. The cover has a functional electrical plug that inserts into the wall outlet and is connected to an extended electrical cord having at its distal end a direct connection to a small appliance, lamp, or electronic device for indirect use of the wall outlet. In one embodiment, the cover is essentially featureless in outward appearance, and when positioned over the wall outlet, the cover fully hides the wall outlet from view. The functional electrical plug has electrical connection pins that are bent at a angle enabling the cover to function without extending any significant degree outward of the wall outlet, so that furniture or the connected appliance, lamp, or device may be positioned effectively flush against the wall in front of the covered wall outlet.

16 Claims, 15 Drawing Sheets

(56) References Cited

U.S. PATENT DOCUMENTS

| | | | | |
|---|---|---|---|---|
| 8,905,780 | B2 | 12/2014 | Vallon | |
| 9,509,080 | B1 | 11/2016 | Insalaco | |
| 9,525,232 | B1 | 12/2016 | Insalaco | |
| D776,064 | S | 1/2017 | Insalaco | |
| 10,305,216 | B1 * | 5/2019 | Shotey | H02G 3/14 |
| 10,516,240 | B1 | 12/2019 | Insalaco | |
| 11,271,351 | B1 * | 3/2022 | Chen | H01R 31/065 |
| 2014/0024247 | A1 | 1/2014 | Riesgaard | |
| 2021/0143587 | A1 * | 5/2021 | Mahood | H01R 13/7135 |

* cited by examiner

FUNCTIONAL INDOOR ELECTRICAL WALL OUTLET COVER

CROSS REFERENCE TO RELATED APPLICATION

This application is a continuation-in-part from U.S. patent application Ser. No. 17/175,604, filed Feb. 12, 2021, pending.

BACKGROUND OF THE INVENTION

1. Field of the Invention

The present invention relates to electrical connector devices. More particularly, the invention relates to indoor electrical outlets and indoor electrical outlet covers.

2. Description of Relevant Art

Electrical service in buildings, particularly in homes, offices, and schools, is typically provided at least in part through electrical wall outlets. Devices needing electrical current for operation or use have electrical cords ending in electrical plugs for connection to an electrical wall outlet. Once the plug is inserted into the wall outlet, electrical current can flow (or does flow if the wall outlet has electrical current flowing into it) to the cord for activating the device needing current.

Most typically, when a plug with a cord is connected to an electrical wall outlet, the plug and cord extend several inches from the wall outlet before the cord curves to a parallel posture with respect to the wall. As a consequence, furniture or other items positioned adjacent to the wall, and even the item plugged into the wall outlet, must be positioned sufficiently away from the wall outlet to accommodate the plug and cord connection to the wall outlet and also to accommodate someone's hand and often times arm in reaching behind the furniture to insert the plug into the wall outlet. Such positioning wastes space in the room and is generally unattractive.

Moreover, typically and commonly used electrical wall outlets are themselves generally unattractive and are known to pose a potential safety hazard for infants and children. Blank cover plates and individual non-conductive plugs are commonly used to prevent children from inserting objects into wall outlet receptacles and getting shocked and injured thereby, but such plates and plugs then prevent use of the outlets.

At times it is desirable to dedicate an outlet to a specific appliance or electronic device but the outlet is not in the specific location desired for the specific appliance or electronic device, or the outlet needs to be covered to prevent access to infants and children, or the appliance or electronic device needs to be connected to the outlet and be flush against the wall adjacent to the outlet. Wiring the specific appliance or electronic device directly into the electrical wiring system in the building could perhaps meet these requirements, and certainly such wiring is known for lighting fixtures such as sconces and ceiling lights. However, installation of such direct wiring is time consuming and typically requires engaging an electrician and accessing the wiring behind the wall which often requires cutting a hole in the wall that later has to repaired. Further, such installation is more permanent than plugging an appliance or electronic device into a wall outlet and does not afford the luxury of easily moving or replacing the wired appliance or device.

Thus there is a need in the art for meeting the needs presented above while overcoming the shortcomings presented above.

SUMMARY OF THE INVENTION

The present invention provides an indoor electrical wall outlet cover that solves the problems associated with indoor outlet covers and allows full access of electrical current from, and use of, the outlet for exclusive access by a particular small appliance, lamp, or electronic device, without requiring direct wiring of the small appliance, lamp, or electronic device to the building's internal electrical wiring structure. The present invention provides an indoor electrical wall outlet cover that is thin enough to avoid adding bulk to the outlet and thus enables the small appliance, lamp, or electronic device (or other items such as furniture) to effectively be positioned against the wall (or at least as close as the baseboard of the wall), that also covers the outlet so as to act as a safety device for a child that may seek to touch or access the outlet receptacles, and that still allows the small appliance or electronic device to be exclusively connected to the outlet and positioned a distance away from the outlet if desired. The present invention effectively provides a combination of advantages of plugging an appliance or electronic device into a wall outlet with advantages of electrically hard wiring the appliance, lamp, or electronic device directly into a wiring system, without the common disadvantages of each.

Moreover, the outlet cover is aesthetically pleasing--it is unobtrusive and calls less attention to itself than does the outlet without the cover of the invention. This is because the outlet cover, at least in one embodiment, is essentially or substantially blank, hides the receptacles of the outlet completely, and results in only one cord extending from the outlet and that extension is in a manner where the cord lies against the wall or along the wall or less than about an inch from the wall, at least when proximate the outlet.

The present invention effects these advantages by providing a thin cover, preferably smooth on the outside, that just extends fully over the surface of an electrical outlet having at least two receptacles, without protruding significantly therefrom and that has an electrical connection component on the backside, in the orientation of a three-prong plug used in North America, that plugs into a receptacle of the outlet for making electrical contact and also for holding the cover in place. In one embodiment, the cover has an electrical connection component on the backside, in the orientation of an two-prong plug used in North America, that plugs into a receptacle of the outlet for making electrical contact and also for holding the cover in place. The difference between a two-prong plug and a three-prong plug is that a three-prong plug has a ground prong and corresponding ground wire, while a two-prong plug does not have a ground wire prong and corresponding ground wire. A three prong-plug is connected to a three core cable comprised of three individually insulated solid cores, typically copper, and individually insulated and wrapped in an outer polymerizing vinyl chloride (known as PVC) sleeving, while a two-prong plug is connected to a two core cable comprised of two individually insulated solid cores, typically copper, and individually insulated and wrapped in an outer PVC sleeving. A three core cable is typically used for appliances with a higher electrical current demand. The electrical connection component of the cover of the invention has an electrical cord attached thereto that extends downward from the electrical connection component out of the cover and falls generally flush against the wall and runs where desired to the small appliance, lamp, or electronic device to which the electrical cord is also connected and at which the electrical cord ends. The electrical connection component has electrical pins bent at approximately ninety degree angles so that the connection of that component in the receptacle does not add bulk or cause the cover to extend significantly beyond the outer surface of the electrical wall outlet.

BRIEF DESCRIPTION OF THE DRAWINGS

The present invention will be better understood by referring to the following detailed description of preferred embodiments and the drawings referenced therein, in which.

REFERENCE NUMERALS IN THE DRAWINGS

Figure 1:
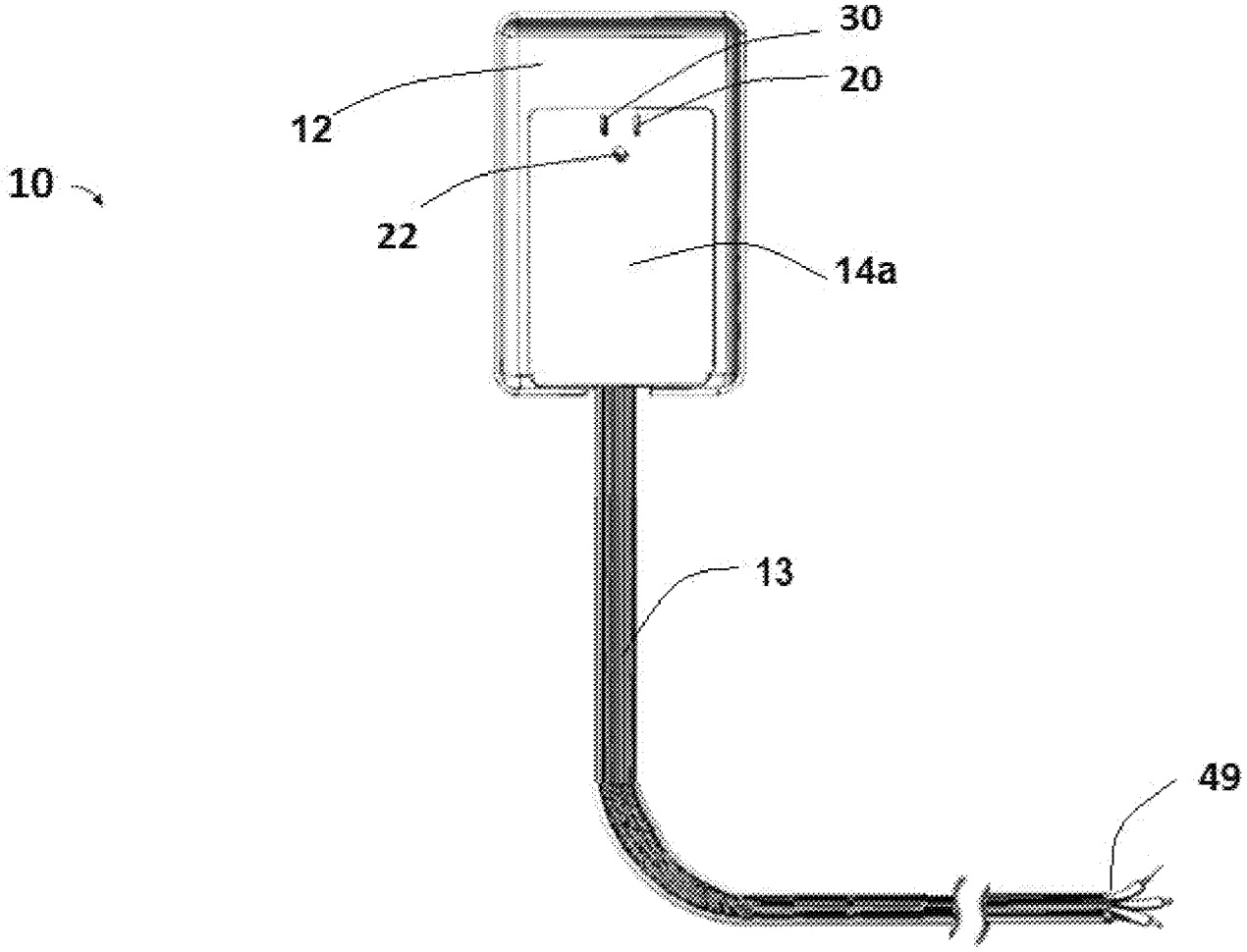
FIG. 1 is a back perspective view (for illustration and not drawn to scale) of one embodiment of the apparatus of the invention having a three-prong plug and a corresponding three core wire, showing the hot, neutral, and ground plug prongs extending out of the back of the cover from an electrical connection component within the cover for connection to a wall outlet plug and where an electrical cord from the electrical connection component within the cover extends from the lower end of the cover, with the cord's distal end prepared for direct electrical wire connection to a small appliance, lamp, or electronic device.

10 one embodiment of the apparatus of the invention
10*a* another embodiment of the apparatus of the invention with a different backplate
10*b* another embodiment of the apparatus of the invention with a different backplate
11 indoor electrical duplex wall outlet
12 frontplate component of cover of apparatus of invention
13 electrical cord having a three core wire with its distal end prepared for direct connection to a small appliance, lamp, or an electronic device
14 backplate component of cover of apparatus of invention
14*a* alternative backplate component
15 cover of apparatus of the invention
16 electrical cord having a two core wire with its distal end prepared for direct connection to a small appliance, lamp, or an electronic device
18 hot electrical pin, of electrical component
19 ground wire, of electrical component
21 baseboard of interior wall 23
22 ground plug prong
23 interior wall
26 electrical receptacle or socket
28 neutral electrical pin, of electrical component
35 electronic device
37 hot plug prong, associated with electrical pin 18
39 neutral plug prong, associated with neutral electrical pin 28
41 ground plug prong associated with ground wire 19
42 first contact in first receptacle 45 in wall outlet 11
44 second contact in first receptacle 45 in wall outlet 11
45 first receptacle in wall outlet 11
48 second receptacle in wall outlet 11
49 distal end of electrical cord having a three core wire and prepared for direct connection to a small appliance or electrical device

49*a* distal end of alternative electrical cord having a two core wire and prepared for direct connection to a small appliance or electrical device

DETAILED DESCRIPTION OF PREFERRED EMBODIMENTS

The present invention provides for the indoor use of electricity through an indoor, thin, blank electrical wall outlet cover in a manner that fully conceals the underlying electrical wall outlet and an electrical plug directly connected to that outlet and an electrical connection component associated with that electrical plug and from which an electrical cord extends past, through, or out of the cover, in one embodiment at the base of the cover, and ending a desired distance away with its distal end directly connected by electrical wires to a small appliance, lamp, or electronic device.

This apparatus of the invention is particularly advantageous as a safety device that permits functional use of a standard or typical indoor electrical wall outlet while fully concealing the wall outlet and particularly concealing and shielding the openings or receptacles in the outlet from access by children. The apparatus of the invention obtains such safety advantage while being so thin as to avoid adding any significant bulk to the wall outlet, thereby enabling a user to position the appliance or device to which the apparatus is connected, or furniture or other items, in front of or adjacent to the outlet and essentially flush with, i.e., less than about an inch away from, the wall on which the outlet is located, or at least as close to the wall as any baseboard on the wall permits, and thereby providing another advantage of the invention.

The present invention eliminates the traditional manner of connecting a visible electrical plug to a visible indoor electrical wall outlet in order to consume electricity through such electrical wall outlet. The present invention also eliminates the traditional manner of accessing electricity for operating a lamp or appliance by hard wiring the lamp or appliance.

Interior electrical wall outlets are points in an interior space of a building such as a home where electrical current can be run to power electrical devices such as appliances and electronics. The most common such outlets are 15-amp (and sometimes 20-amp) duplex receptacles, which are designed to accept standard plugs for most small appliances, electronics such as televisions and home theater systems as well as cellular phones and portable computing devices such as laptops and tablet computers, and lamps. The invention has utility with any such interior electrical wall outlets and the term "typical (or standard) indoor electrical wall outlet" herein is understood to refer to such outlets as well as similar outlets that have more receptacles.

Figure 5:
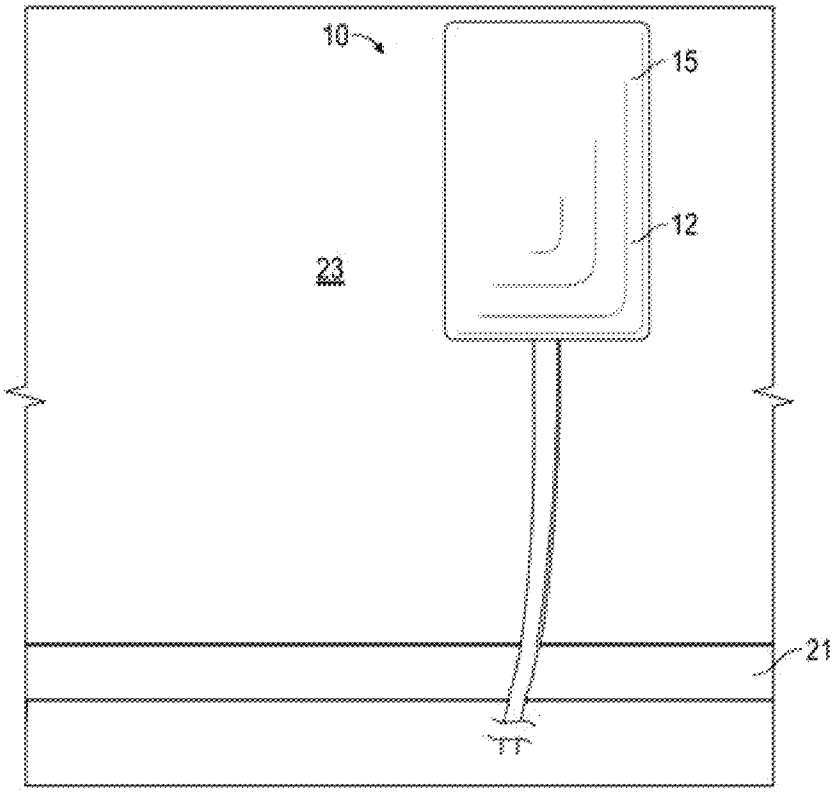
FIG. 5 is a front perspective view (for illustration and not drawn to scale) of the embodiment of the apparatus of FIG. 1 (or FIG. 9), as shown in place on an electrical outlet as it might typically be used.
Figure 6:
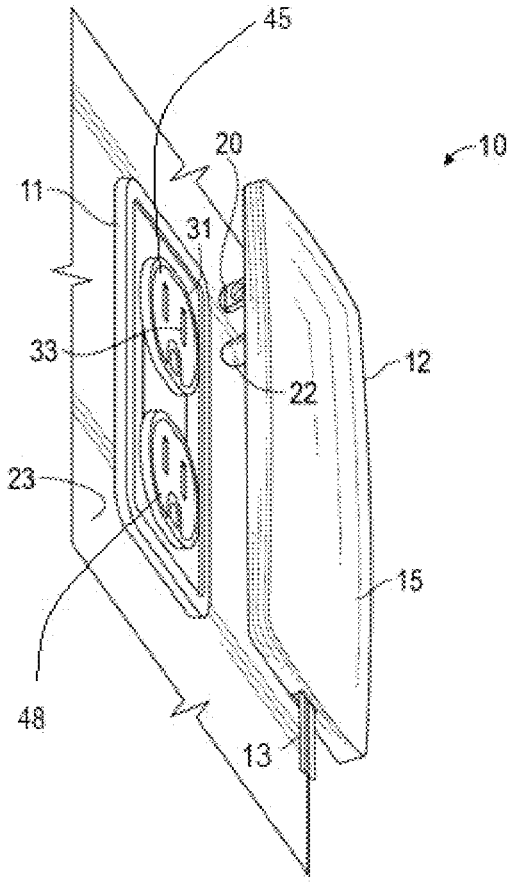
FIG. 6 is an enlarged front side perspective view of an alternative embodiment of the apparatus of the invention having a three-prong plug and a corresponding three core wire, just before it is placed over a typical electrical outlet on a wall (for illustration and not drawn to scale).
Figure 7:
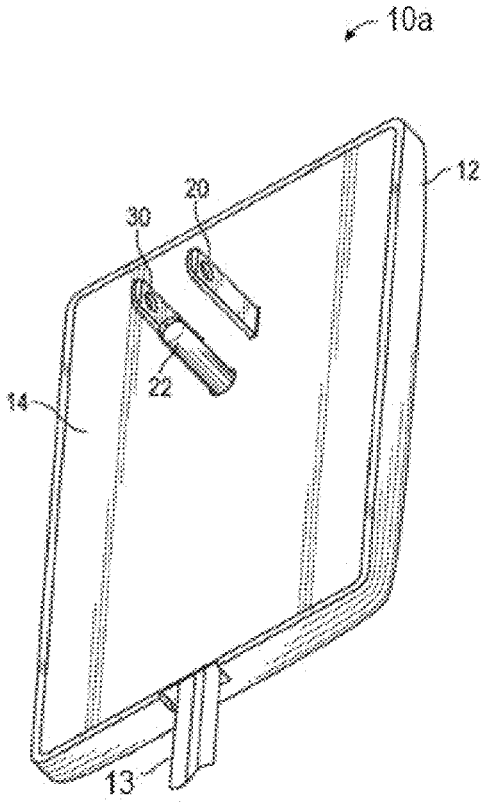
FIG. 7 is a back perspective view of the apparatus of the invention of FIG. 6 having a three-prong plug and a corresponding three core wire.
Figure 8:
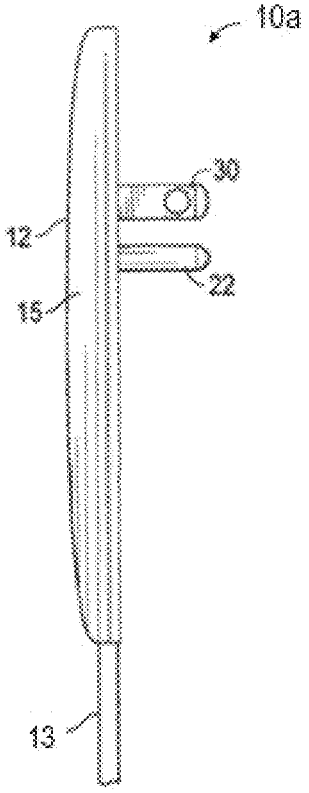
FIG. 8 is a side view of the embodiment of the apparatus of the invention of FIG. 6 having a three-prong plug and a corresponding three core wire.
Figure 9:
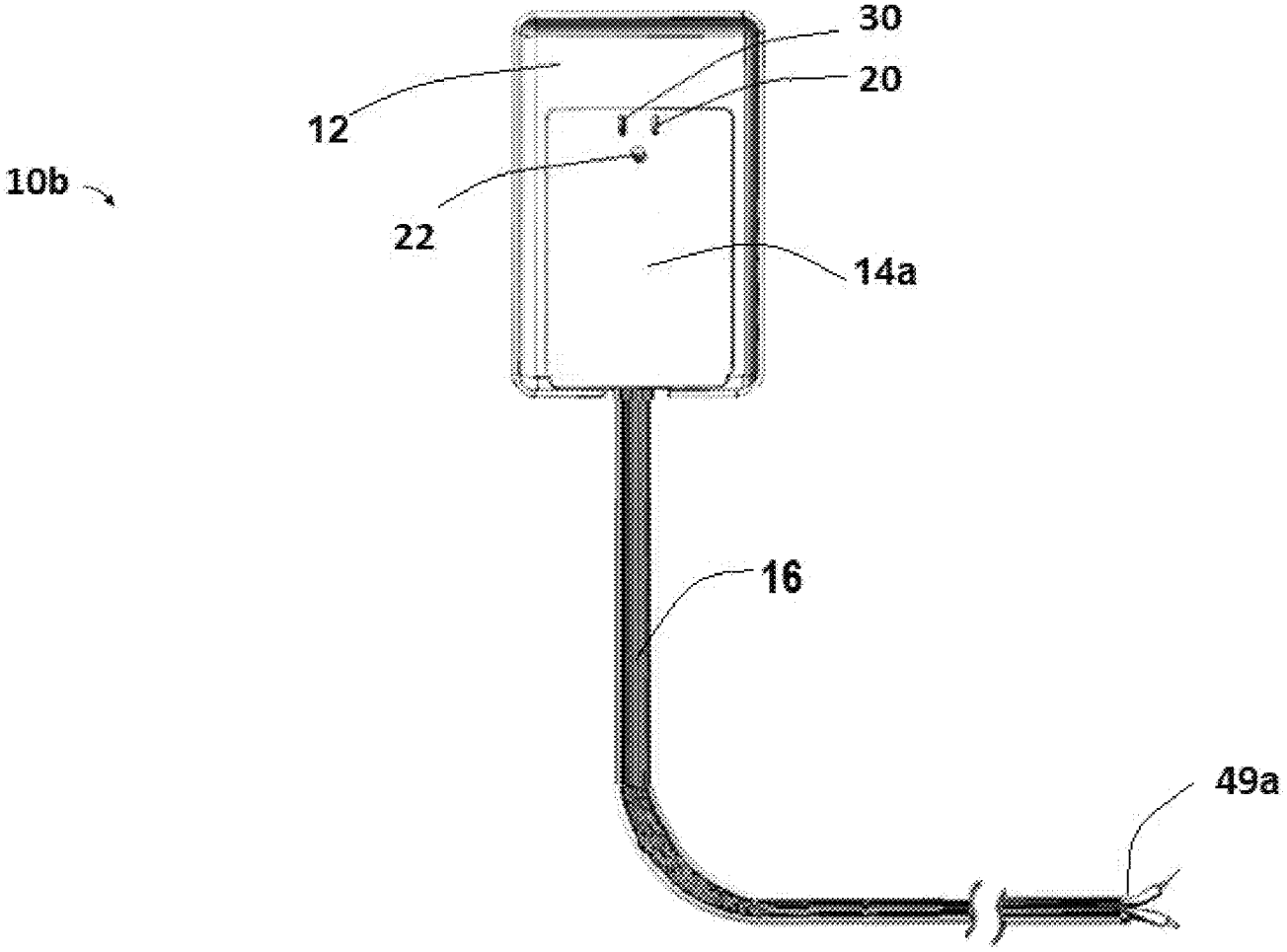
FIG. 9 is a back perspective view (for illustration and not drawn to scale) of one embodiment of the apparatus of the invention having a two-prong plug and a corresponding two core wire, showing the hot and neutral plug prongs extending out of the back of the cover from an electrical connection component within the cover for connection to a wall outlet plug and where an electrical cord from the electrical connection component within the cover extends from the lower end of the cover, with the cord's distal end prepared for direct electrical wire connection to a small appliance, lamp, or electronic device.
Figure 10:
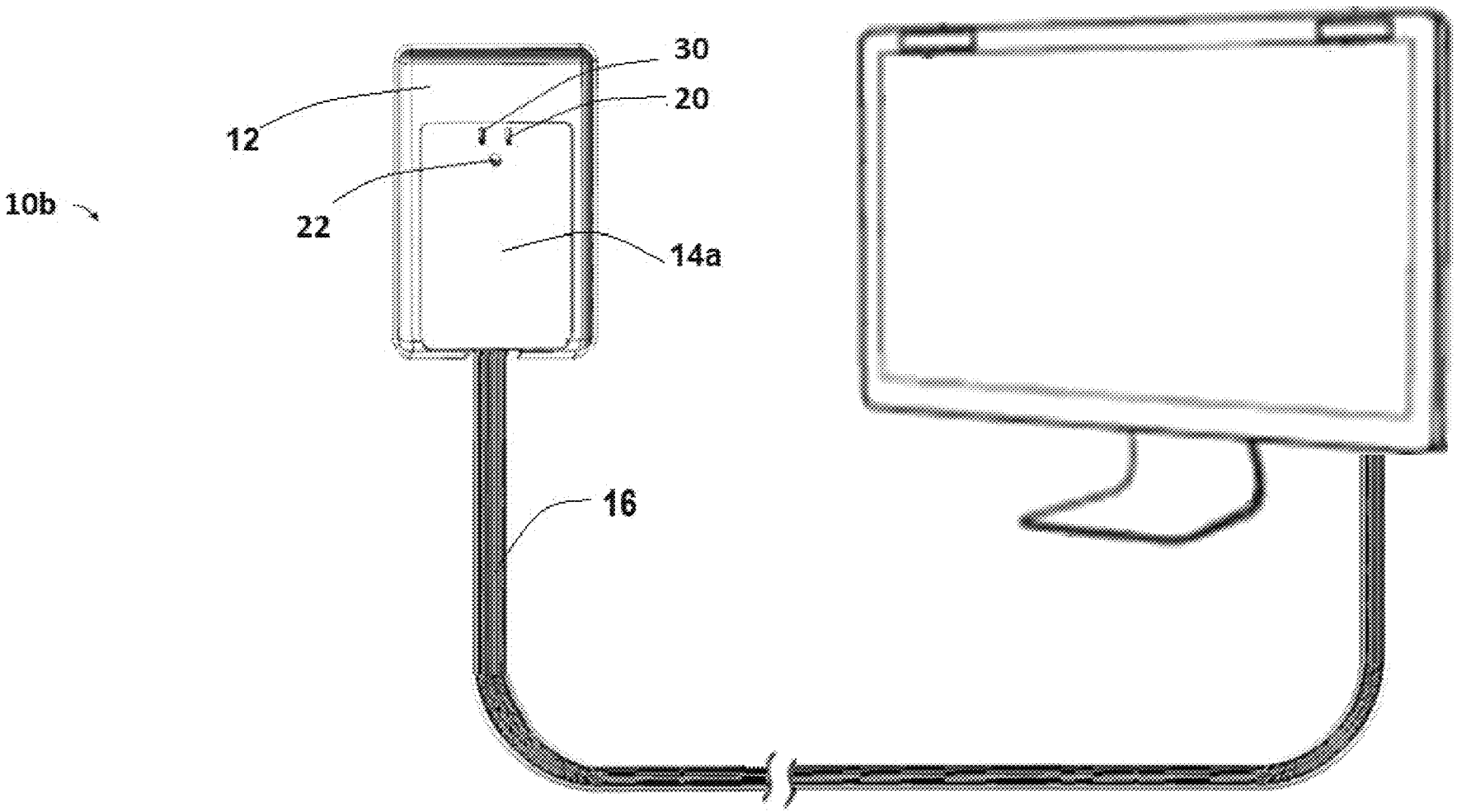
FIG. 10 is another back perspective view (for illustration and not drawn to scale) of the embodiment of FIG. 9 having a two-prong plug and a corresponding two core wire and showing an electronic device connected to the distal end of the electrical cord.
Figure 11:
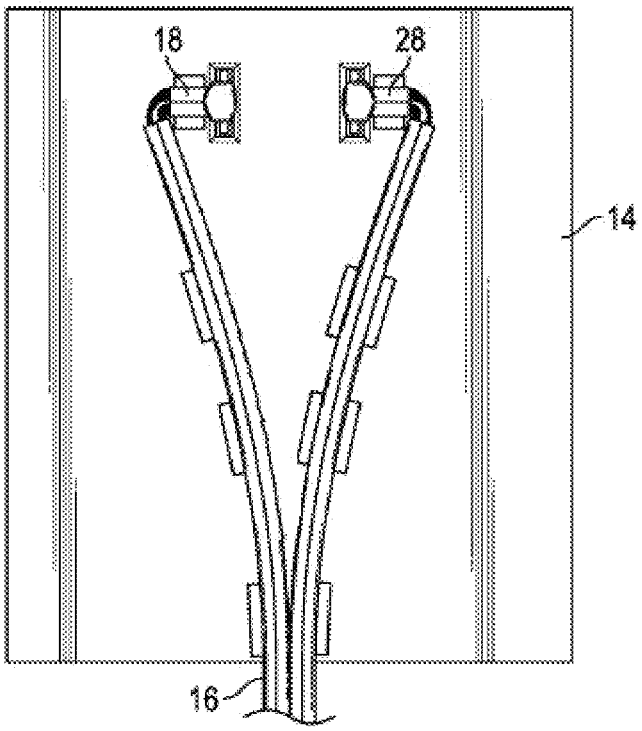
FIG. 11 is a view of the inside of the back plate of the embodiment of the apparatus of FIG. 9 having a two-prong plug and a corresponding two core wire and showing the electrical connection component having electrical pins bent at a ninety degree angle with respect to each of the two legs of each electrical pin.
Figure 12:
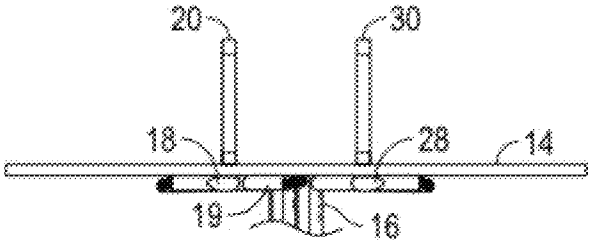
FIG. 12 is a top view of the back plate of the embodiment of the apparatus of FIG. 9 having a two-prong plug and a corresponding two core wire and showing the electrical pins and the ground pin as they extend out of the back plate.

Referring to FIGS. 1-6, one embodiment of the apparatus of the invention 10 is shown, and referring to FIGS. 7-8, another embodiment of the apparatus of the invention 10*a* is shown. These two embodiments are substantially alike except for the backplate on the back of the cover. The difference is intended to show that variations can be made in the outward appearance of the cover of the invention without substantively altering the functionality and advantages of the invention. Still another embodiment of the apparatus of the invention 10*b* is shown in FIGS. 9-15. This embodiment is substantially like the embodiment shown in FIGS. 1-6 except that apparatus of the invention 10*b* in FIGS. 9-15 has a two-prong plug and a corresponding two core wire, instead of the three-prong plug and a corresponding three core wire of the apparatus of the invention 10 in FIGS. 1-6. Thus, unless specifically indicated otherwise herein, references to the embodiment of the apparatus of the invention 10 shall be understood to apply to the embodiment of the apparatus of the invention 10*a* and to the embodiment of the apparatus of the invention 10*b*.

Figure 2:
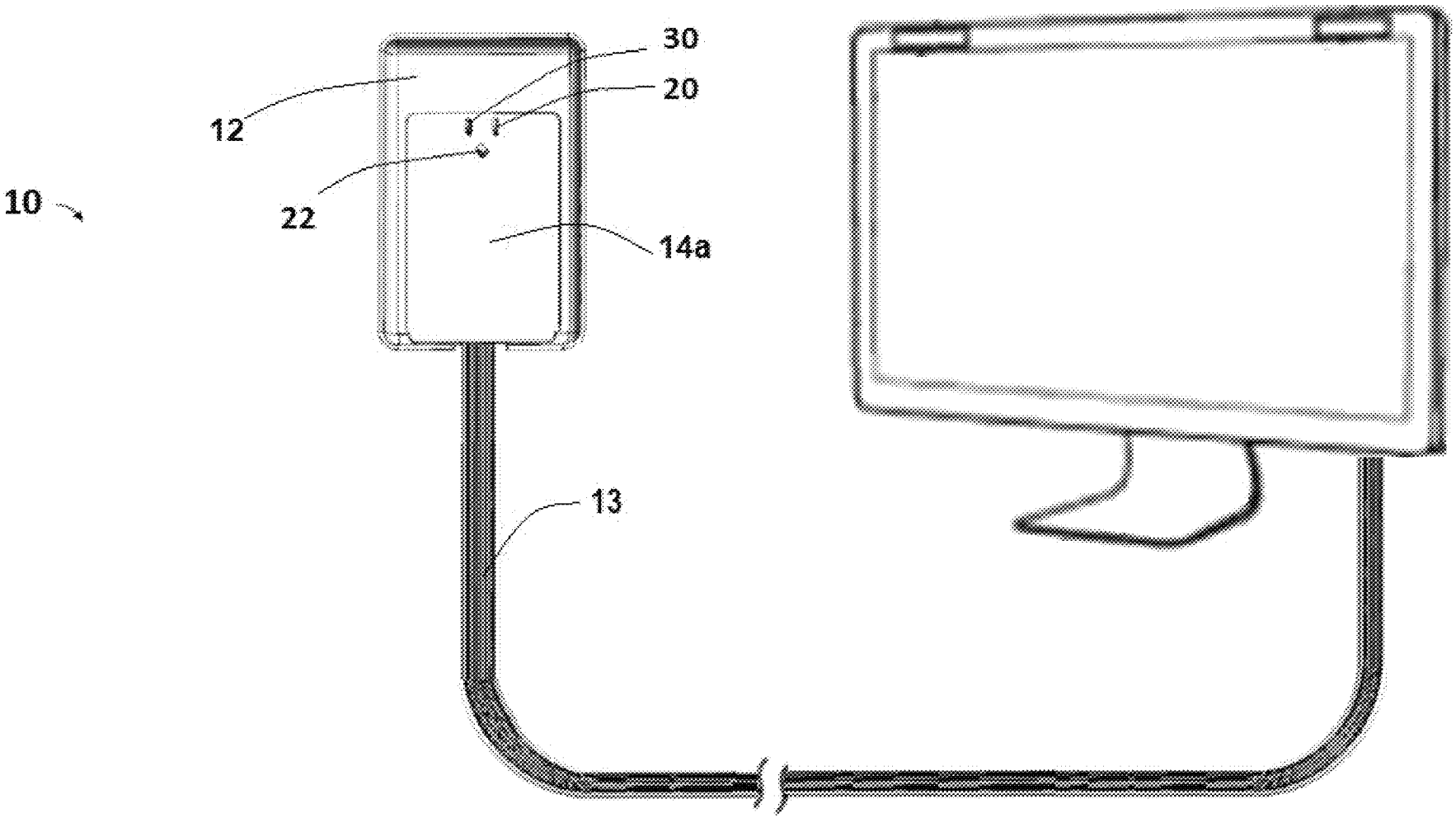
FIG. 2 is another back perspective view (for illustration and not drawn to scale) of the embodiment of FIG. 1 having a three-prong plug and a corresponding three core wire and showing an electronic device connected to the distal end of the electrical cord.
Figure 13:
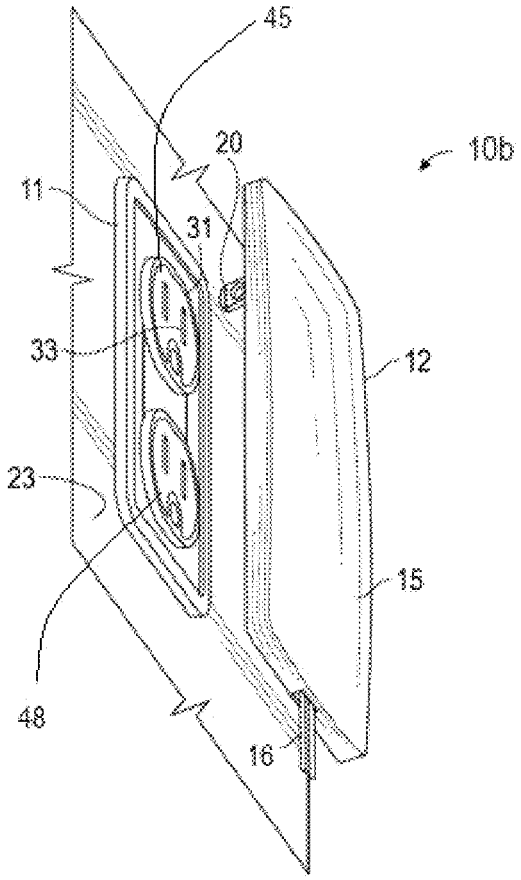
FIG. 13 is an enlarged front side perspective view of an alternative embodiment of the apparatus of the invention having a two-prong plug and a corresponding two core wire, just before it is placed over a typical electrical outlet on a wall (for illustration and not drawn to scale).

FIG. 5 shows the apparatus 10 (10*a* and 10*b* would appear the same) positioned over a typical indoor electrical wall outlet (not shown in FIG. 5 but shown in FIG. 6) on an interior wall 23. FIG. 6 shows the cover 15 of apparatus 10 just before placement over the electrical wall outlet 11 and indicates the thin, low profile of cover 15. FIGS. 8 and 13 also show the side of cover 15 for the apparatuses 10*a* and 10*b* respectively, further indicating the thin, low profile of cover 15, particularly comprising frontplate component 12 mounted on backplate components 14*a* and 14*b*. FIGS. 1 and 2 are drawn to illustrate features of the invention and are not drawn to scale. That is, cover 15 is drawn larger with respect to the remainder of the apparatus 10 and the electronic device to which it is connected, and with respect to the wall outlet 11, than is actually contemplated to in fact occur with the embodiments of the invention as will be more fully explained below.

As used herein, the term "frontplate" with respect to the apparatus of the invention and particularly cover 15 means the faceplate or faceplate component of cover 15, and not the common faceplate of the wall outlet. The apparatus of the invention is used to hide the wall outlet 11 but no change or adjustment in the wall outlet 11 needs to be made. That is, the common faceplate of the wall outlet 11 does not need to be removed. To avoid any confusion between the common faceplate of a wall outlet and the faceplate of the cover of the apparatus of the invention, the faceplate component of the cover 15 of the apparatus 10 of the invention will be called herein the "frontplate."

The frontplate and backplate components of the invention are made of material that satisfies NEMA Standards or standards for UL safety certification. Such materials are characterized by resistance to chemicals, heat and impact, and typical applications include use in appliance housings and electronic and electrical assemblies. These materials include various plastics, including acrylonitrile butadiene styrene or ABS and polyvinyl chloride or PVC.

The maximum distance between the backplate component 14 (or 14*a* or 14*b*) and the frontplate component 12 is approximately the height or thickness of the electrical cord 13 (or 16) connected to or attached to the backplate component 14, and this distance is only in the main body or central portion of the cover 15, as the outer or perimeter edges of the components 12 and 14 are proximate one another and touch or essentially touch, with the perimeter edge of backplate component 14 or 14*a* or 14*b* fitting inside the outer edge of frontplate component 12, as shown in FIGS. 1, 2, 7 and 14. The frontplate component 12 is sized to align and position over and preferably curve slightly around or up to the perimeter edge of the backplate component 14 or 14*a* or 14*b* for a tight fit—preferably tight enough to require no adhesive or screws to hold the components 12 and 14 (or 14*a* or 14*b*) together.

Figure 3:
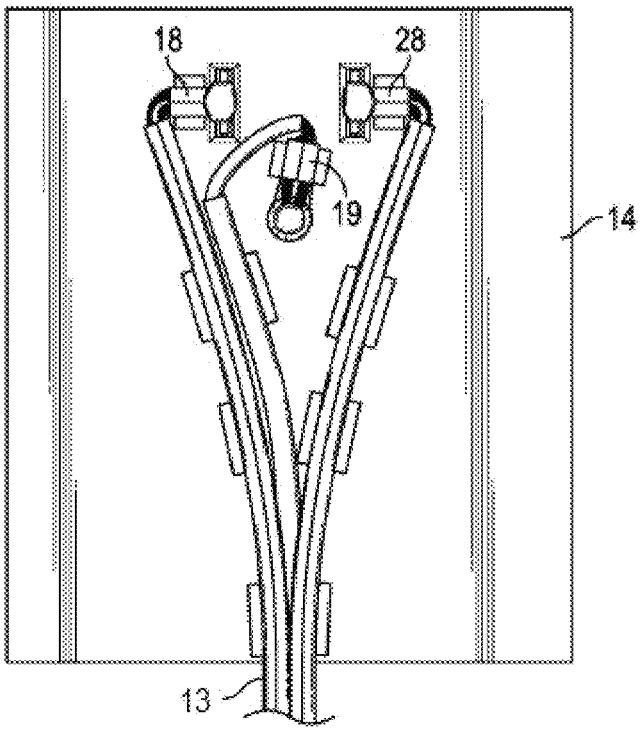
FIG. 3 is a view of the inside of the back plate of the embodiment of the apparatus of FIG. 1 having a three-prong plug and a corresponding three core wire and showing the electrical connection component having electrical pins bent at a ninety degree angle with respect to each of the two legs of each electrical pin.

An integral aspect of this embodiment of the apparatus 10 of the invention is the electrical pins 18 and 28 and ground wire 19, which are bent at approximately a ninety degree angle with respect to the backplate component 14 (14*a* and 14*b* would be the same) and fastened to the backplate component 14 (14*a* would be the same), as shown in FIG. 3. In this aspect, the height of the horizontal portion of each electrical pin 18 and 28 and the ground wire 19 is approximately less or the same height (or thickness) as the electrical cord 13 (or electrical cord 16), which is attached to the electrical pins 18 and 28 and to ground wire 19. Electrical cord 13 (or electrical cord 16) is also optionally attached to the backplate component 14 (14*a* or 14*b*).

A benefit of the electrical pins 18 and 28 and the ground wire 19 being bent at a ninety degree angle is that the depth of the cover 15, measured by the distance between the wall 23 when the cover 15 is inserted in the underlying electrical wall outlet 11 and the front face of the cover or the outer or exterior surface of the frontplate component 12, resting on top of the backplate 14 (or 14*a* or 14*b*) which in turn is resting on top of the underlying electrical wall outlet 11, is less than the depth of a typical electrical plug connected in a traditional manner to the electrical wall outlet 11, which is a typical electrical wall outlet, and cover 15 may have less depth than the depth of baseboard molding 21 at the base of the wall 23. For example, a typical electrical plug is at least about an inch wide and when on an electrical cord and inserted into an electrical wall outlet, such as electrical wall outlet 11, such plug and adjacent cord typically protrude or extend outwardly from the outlet a distance of more than an inch and often protrude as much as about two inches to even four inches. In contrast, the cover 15 of the apparatus 10 (or 10*a* or 10*b*) of the invention when placed over the electrical wall outlet 11 extends outward from the outlet no more than the thickness of the cover 15. Cover 15 is as thin as the thickness of the combination of the frontplate component 12 mounted on the backplate component 14 and the electrical pins 18 and 28, the ground wire 19, and electrical cord 13 in between the components 12 and 14. This combined thickness, or thinness, is less than about an inch and also is less than the thickness of a typical baseboard at the base of a wall in preferred embodiments.

Figure 4:
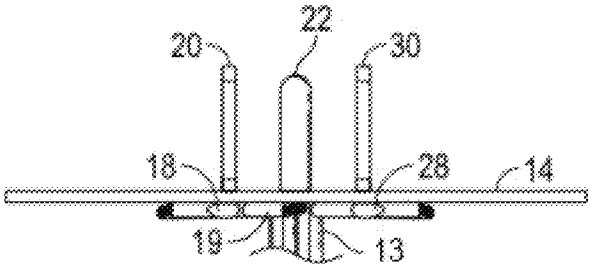
FIG. 4 is a top view of the back plate of the embodiment of the apparatus of FIG. 1 having a three-prong plug and a corresponding three core wire and showing the electrical pins and the ground pin as they extend out of the back plate.

As shown in FIG. 4, electrical pin 18 is associated with plug prong 20 (neutral), electrical pin 28 (hot) is associated with plug prong 30, and ground wire 19 is associated with ground plug prong 22 (ground). These plug prongs 20, 30 and 22 are like typical electrical plug prongs used in typical wall outlets.

The conductive electrical pins 18 and 28 and ground wire 19 and corresponding plug prongs 20, 30 and 22 comprise a configuration of one of about fifteen electrical plug types currently in use, as categorized by the U.S. Department of Commerce International Trade Administration. An integral aspect of this embodiment is connection of the electrical pins 18 and 28, through respective plug prongs 20 and 30, to the respective contacts 31 and 33 in a receptacle 45 of wall outlet 11 as shown in FIG. 6 and FIG. 13 of the underlying interior electrical wall outlet 11 without any visible electrical pins 18 or 28 (or visible ground wire 19), which are all fully concealed under the backplate component 14 and the frontplate component 12 mounted to the backplate component 14 (or 14*a*). Electrical pins 18 and 28 and ground wire 19 comprise the proximal end of electrical cord 13 of the apparatus 10 (and apparatus 10*a*) of the invention. Electrical pins 18 and 28 similarly comprise the proximal end of electrical cord 16 of the apparatus 10*b* of the invention.

The opposite or distal end of the electrical cord 13 (or 16) is directly connected through electrical wires to a small appliance, lamp or electronic device 35 for utility, namely electricity consumption. Such third-party small appliances, lamps and electronic devices (and the like) are not part of the invention. The exact desired length of electrical cord 13 (or 16) will vary depending on the intended use of the invention, that is, depending on the particular small appliance, lamp or electronic device that will be attached to the electrical cord 13 (or 16) and depending on the expected desired positioning of that appliance, lamp, or electronic device. In one embodiment for example, such as for a lamp or a television for non-limiting example, the length is sufficient for electrical cord 13 (or 16) to extend from backplate 14 (or 14*a* or 14*b*) or cover 15 and be manually guided around any adjacent or nearby furniture and positioned so that the distal end of the electrical cord 13 (or 16) of apparatus 10 (or 10*a* or 10*b*) of the invention and its attached lamp or television are conveniently and safely located for use. In one embodiment, for example, the distance the cord will extend is selected from a range of about three feet to about thirty feet, although many different variations would work, and longer cords could be used. The length of the cord is generally limited by practical reasons—one does not want a cord so long that excess cord gets in the way of furniture and becomes unsightly or a tripping hazard. In another embodiment, the length of electrical cord 13 (or 16) may be short—only so long as to reasonably enable the cover 15 to be plugged into the wall outlet 11 with the attached small appliance, lamp, or electronic device positioned in front of or adjacent the wall outlet 11. As stated above, the present invention can advantageously enable furniture, or the appliance or device to which the apparatus of the invention is connected, to be positioned flush against the wall and in front of a wall outlet covered by the cover 15 of the apparatus of the invention.

As indicated above, through use of electrical cord 13 (or 16), the apparatus of the present invention advantageously eliminates the need to attach an electrical plug of a small apparatus, lamp, or electronic device directly to the contact openings or receptacles of an electrical wall outlet for use of the outlet.

Figure 14:
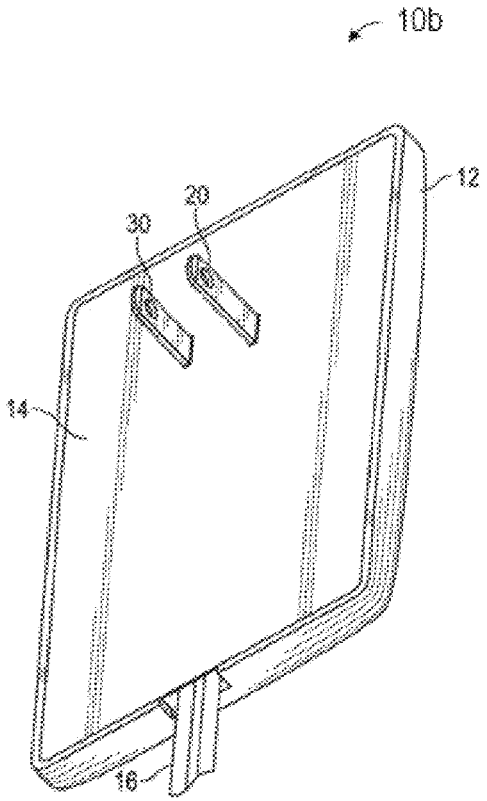
FIG. 14 is a back perspective view of the apparatus of the invention of FIG. 13 having a two-prong plug and a corresponding two core wire.
Figure 15:
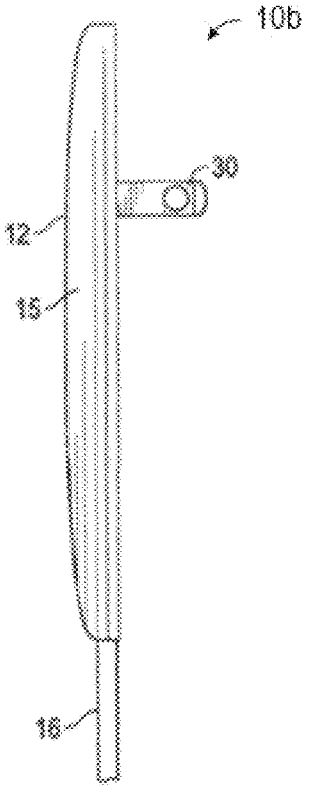
FIG. 15 is a side view of the embodiment of the apparatus of the invention of FIG. 13 having a two-prong plug and a corresponding two core wire.

The apparatus of the invention also advantageously can be used with any standard, conventional, or typical indoor electrical wall outlet, without having to make any adjustments or physical changes in the wall outlet. Screws are not needed for attachment of the cover of the apparatus of the invention to the wall outlet for covering the wall outlet and the wall outlet does not need to be replaced with a frontplate particularly designed to fit with the cover of the apparatus of the invention. Rather, the apparatus of the invention and particularly the cover 15 of the apparatus of the invention 10 is held in place over the wall outlet 11 by insertion of prongs 20, 30, and 22, in receptacle 45 of the wall outlet 11, as indicated in FIG. 6. In alternative embodiment of the apparatus of the invention 10*a*, cover 15 of apparatus 10*a* of the invention is held in place over the wall outlet 11 by insertion of prongs 20, 30, and 22 of apparatus 10*a* as shown in FIGS. 7 and 8, in receptacle 45 of the wall outlet 11, as indicated in FIG. 6 considered with FIGS. 7 and 8. In alternative embodiment of the apparatus of the invention 10*b*, cover 15 of apparatus 10*b* of the invention is held in place over the wall outlet 11 by insertion of prongs 20 and 30 of apparatus 10*b* as shown in FIGS. 14 and 15, in receptacle 45 of the wall outlet 11, as indicated in FIG. 13 considered with FIGS. 14 and 15.

Wall outlet 11, as indicated in FIG. 6, is a standard, conventional, or typical indoor electrical wall outlet, which is believed to be commonly called a one-gang electrical wall outlet, and which has two receptacles or sockets, an upper and a lower receptacle or socket, in vertical alignment with each other. Thus, the apparatus of the invention 10 (or 10*a*) attaches to such a standard wall outlet 11 having two receptacles or sockets 45 and 48 by insertion of the plug prongs 30, 20, and 22 of the apparatus of the invention 10 into the upper wall outlet receptacle 45 as shown in FIG. 6.

Similarly, the apparatus of the invention 10*b* attaches to such a standard wall outlet 11 having two receptacles or sockets 45 and 48 by insertion of the plug prongs 30 and 20 into the upper wall outlet receptacle 45 of the invention 10*b* into the upper wall outlet receptacle 45. In one embodiment, the apparatus of the invention could be similarly used with a standard one-gang electrical wall outlet having two receptacles or sockets aligned in a horizontal position. In such case, electrical cord 13 (or 16) would extend from one side of the cover 15, rather than the base of the cover 15 as shown in FIGS. 1 (and 9), or could be adapted (i.e., moved) to extend from the base of the cover in the horizontal position, that is, the cover 15 can be adapted so that the cord could extend from any of the four sides of the cover 15. Similarly, while the apparatus 10 (and 10*a*, and 10*b*) have been shown in the FIGs. for positioning over a two receptacles or sockets aligned in a horizontal position with the electrical cord 13 (or 16) extending from the base of the cover 15, such cover could be adapted for the electrical cord 13 (or 16) to extend instead from the top or any of the sides of the cover 15.

The apparatus of the present invention can also be readily adapted for standard, conventional, or typical multi-gang outlets, such as for nonlimiting example, double or triple wall outlets. Such outlets tend to simply be double, triple, quadruple, or other multiple versions of a single gang outlet and thus respectively have four, six, eight, or other multiple receptacles or sockets typically aligned in pairs. Thus the apparatus of the invention would be expanded to accommodate four, six, eight, or other multiple pairs of electrical plugs. For another example, in one such alternative embodiment, the multi-gang electrical outlet is sized to support up to about sixteen receptacles or sockets, normally allowing attachment or insertion into the multi-gang electrical outlet as many as sixteen electrical plugs, or an apparatus of the invention with eight electrical plugs.

In such alternative embodiments of the invention not shown for use in multi-gang outlets, the backplate component of the cover of the apparatus of the invention is sized to align and position over such standard indoor multi-gang electrical wall outlet. The frontplate component is sized to align and position over and curve slightly around the perimeter edge of the backplate component for a tight fit as described above that preferably requires no adhesive or screws to stay in place. To add to the aesthetics of the cover 15 of the invention, in one embodiment at least the front or exterior of the frontplate is painted or is covered in wallpaper.

In another embodiment of the apparatus of the invention, having an alternative electrical connection to that discussed above and illustrated in FIG. 3, the electrical pins are fastened to the backplate component and connected to an insulated conductive connector which in turn is connected to a wire forming a part of the electrical cord at the proximal end and one or more wires at the distal or opposite end of the electrical cord to which one or more small appliances, lamps or electronic devices are connected for electricity consumption.

The present invention has been illustrated with electrical plugs and receptacles having shapes that are commonly used in the United States of America. However, it is known that different shaped electrical plug prongs and receptacles are used in different countries and the present invention may readily be adapted for those different shapes.

While preferred embodiments of the present disclosure have been described, it should be understood that other various changes, adaptations and modifications can be made therein without departing from the spirit of the invention(s) and the scope of the appended claims. The scope of the present disclosure should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. An apparatus for hiding a standard indoor electrical wall outlet having at least one receptacle while affording continued use of that said outlet, the apparatus comprising:

a. a cover comprising:
   (i) a frontplate; and
   (ii) a backplate comprising at least one set of electrical prongs including a hot prong, a neutral prong, and optionally a ground prong, positioned to correspond to a first receptacle of the wall outlet; and b. an electrical cord extending from the backplate, or the cover, said cord comprising at the cord's proximal end: at least one hot pin, at least one neutral pin and optionally a ground wire positioned on or fastened or attached to the backplate of the cover in such manner as to minimize distance between the front plate and the backplate, and respectively connected to or associated with the hot prong, neutral prong and any ground prong on the exterior of the backplate, wherein the hot pin and the neutral pin are positioned at approximately right angles to the backplate;

and wherein the cord's distal end is prepared for direct wiring to, and ending in, a small appliance, lamp, or electronic device, to be directly connected by electrical wires to said cord.

2. The apparatus of claim 1 wherein the ground wire is provided and is positioned at approximately right angles to the backplate.

3. The apparatus of claim 1 wherein the height of the hot pin, neutral pin, and any ground wire is approximately the same or less than the thickness of the cord.

4. The apparatus of claim 1 wherein the backplate fits inside the frontplate and the backplate and the frontplate hold together without fasteners, attachers, or adhesive.

5. The apparatus of claim 1 wherein the frontplate has perimeter edges and the backplate has outer edges and the perimeter edges of the frontplate curve over the outer edges of the backplate.

6. The apparatus of claim 1 wherein the electrical cord extends from the top, bottom or one of the sides of the backplate or cover.

7. The apparatus of claim 1 wherein the cover has a shape mimicking the wall outlet but sufficiently larger to completely cover the wall outlet when held on or over the wall outlet by insertion of the set of electrical prongs into the at least one receptacle of the wall outlet.

8. The apparatus of claim 1 wherein the cover is held on or over the wall outlet by insertion of the at least one set of electrical prongs into the at least one receptacle of the wall outlet and the cover does not extend outwardly from the wall outlet more than about an inch.

9. The apparatus cover of claim 1 wherein the frontplate has a blank exterior surface with no apertures.

10. The apparatus of claim 9 wherein the frontplate has an exterior surface painted or covered with fabric or wallpaper.

11. The apparatus of claim 1 wherein at least one side of the frontplate or backplate has, or one side of the frontplate and backplate together have, or form, a hole or slot and the cord extends from said hole or slot.

12. The apparatus of claim 1 wherein the distance that the cord extends from the cover is an amount selected from the range of about three feet to about thirty feet.

13. The apparatus of claim 1 wherein the distance from the cover to the small appliance, lamp or electronic device at the distal end of the cord is no more than an amount sufficient for the small appliance, lamp or electronic device to be positioned in front of or adjacent the cover when the cover is in place over the wall outlet.

14. A functional indoor electrical wall outlet cover for hiding a standard indoor electrical wall outlet having two receptacles while affording continued use of that outlet, the apparatus comprising:

a. a frontplate of the cover;

b. a backplate of the cover comprising:

(i) one set of electrical prongs including a hot prong, a neutral prong, and a ground prong, positioned to correspond to a first receptacle of the wall outlet; and c. an electrical cord extending from the top, bottom, or one of the side edges of the backplate or the cover, said cord comprising:

at the cord's proximal end: at least one hot pin, at least one neutral pin, but no ground wire, positioned at right angles on the backplate of the cover in such manner as to minimize the distance between the front plate and the backplate so that said distance does not exceed the thickness of the cord, and said hot pin and neutral pin are respectively connected to or associated with the hot prong and neutral prong on the exterior of the backplate; and wherein the cord's distal end is prepared for direct wiring to, and ending in a small appliance, a lamp, or an electronic device to be directly and electrically wired by electrical wires to said cord.

15. The apparatus of claim 14 wherein the frontplate has perimeter edges and the backplate has outer edges and the perimeter edges of the frontplate curve over the outer edges of the backplate, the backplate fits inside the frontplate, and the backplate and the frontplate hold together without fasteners, attachers, or adhesive.

16. A functional indoor electrical wall outlet cover for hiding a standard indoor electrical wall outlet having two receptacles while affording continued use of that outlet, the apparatus comprising:

a. a frontplate of the cover;

b. a backplate of the cover comprising:

(i) one set of electrical prongs including a hot prong and a neutral prong, but not a ground prong, positioned to correspond to a first receptacle of the wall outlet; and c. an electrical cord extending from the top, bottom or one of the side edges of the backplate or the cover, said cord comprising:

(i) at the cord's proximal end: at least one hot pin and at least one neutral pin, but no ground wire, positioned at right angles on the backplate of the cover in such manner as to minimize the distance between the front plate and the backplate so that said distance does not exceed the thickness of the cord, and said hot pin and neutral pin are respectively connected to or associated with the hot prong and the neutral prong on the exterior of the backplate, and wherein the cord's distal end is prepared for direct wiring to, and ending in, a small appliance, a lamp, or an electronic device to be directly and electrically wired by electrical wires to said cord.

* * * * *